US007233246B2

(12) United States Patent
Nichols, Sr.

(10) Patent No.: US 7,233,246 B2
(45) Date of Patent: Jun. 19, 2007

(54) HARD COVER PRODUCT WITH SPINE-DISPOSED CONCEALED SECURITY DEVICE

(75) Inventor: Dale Hunt Nichols, Sr., Brentwood, TN (US)

(73) Assignee: Smartguard, LLC, Nashville, TN (US)

( * ) Notice: Subject to any disclaimer, the term of this patent is extended or adjusted under 35 U.S.C. 154(b) by 119 days.

(21) Appl. No.: 10/951,191

(22) Filed: Sep. 27, 2004

(65) Prior Publication Data

US 2007/0103309 A1 May 10, 2007

Related U.S. Application Data

(60) Provisional application No. 60/562,586, filed on Apr. 14, 2004.

(51) Int. Cl.
*G08B 13/14* (2006.01)

(52) U.S. Cl. ..... 340/572.1; 340/572.8; 340/539.1; 340/541; 340/693.5; 340/693.9; 340/825.69

(58) Field of Classification Search ..... 340/572.1, 340/572.3, 572.4, 572.8, 539.1, 5.8, 825.69, 340/540, 541, 693.5, 693.9, 693.12; 325/487
See application file for complete search history.

(56) References Cited

U.S. PATENT DOCUMENTS

| | | | | |
|---|---|---|---|---|
| 4,709,813 | A | 12/1987 | Wildt | 206/312 |
| 4,784,264 | A | 11/1988 | Sykes | |
| 4,966,020 | A | 10/1990 | Fotheringham et al. | 70/276 |
| 5,031,756 | A | 7/1991 | Buzzard et al. | 206/1.5 |
| 5,209,086 | A | 5/1993 | Brühwiler | 70/57.1 |
| 5,236,081 | A | 8/1993 | Fitzsimmons et al. | 206/44 |
| 5,276,435 | A | 1/1994 | Rossides | 340/691 |
| 5,297,672 | A | 3/1994 | MacTavish | 206/1.5 |
| 5,598,728 | A | 2/1997 | Lax | 70/276 |
| 5,620,271 | A | 4/1997 | Bergh et al. | |
| 5,656,998 | A | 8/1997 | Fujiuchi et al. | 340/571 |
| 5,680,782 | A | 10/1997 | Komatsu et al. | 70/54.1 |
| 5,718,332 | A | 2/1998 | Tachibana | 206/308.2 |

(Continued)

FOREIGN PATENT DOCUMENTS

| | | |
|---|---|---|
| WO | WO 9315294 | 5/1993 |

OTHER PUBLICATIONS

"*The Henderson Network*"; web page article from http://www.cypak.com/index.php?a=pressroom&b=newscomdex021121;Aug. 18, 2004; www.cypak.com, Cypak AB, Funckens Gränd 1, Box 2332, 103 18 Stockholm, Sweden.

(Continued)

*Primary Examiner*—Hung Nguyen
(74) *Attorney, Agent, or Firm*—Baker, Donelson, Bearman, Caldwell & Berkowitz, PC

(57) ABSTRACT

A hard cover product having an outer liner attached to a pair of sheet members disposed in spaced-apart relation to define a gap. One of the hard sheet members defines a receiving zone that receives a security tag. An inner liner attaches overlying the pair of hard sheet members and concealing the security tag within the receiving zone. The gap between the pair of sheet members defines a spine for the hard cover product, whereby the opposing hard sheets defining a front cover and back cover that move together foldably.

14 Claims, 7 Drawing Sheets

U.S. PATENT DOCUMENTS

| | | | | |
|---|---|---|---|---|
| 5,749,735 | A * | 5/1998 | Redford et al. | 434/307 R |
| 5,762,377 | A | 6/1998 | Chamberlain | 283/67 |
| 5,782,350 | A | 7/1998 | Weisburn et al. | 206/308.2 |
| 5,802,890 | A | 9/1998 | Espada-Velasco | 70/57.1 |
| 5,812,065 | A | 9/1998 | Schrott et al. | 340/825.54 |
| 5,823,341 | A | 10/1998 | Nakasuji | |
| 5,850,752 | A | 12/1998 | Lax | 70/276 |
| 5,882,052 | A | 3/1999 | Whitehead | 292/80 |
| 5,910,770 | A | 6/1999 | Ohara | |
| 5,984,388 | A | 11/1999 | Bacon | 292/307 R |
| 5,988,376 | A | 11/1999 | Lax | 206/308.2 |
| 6,082,156 | A | 7/2000 | Bin | 70/57.1 |
| 6,100,804 | A | 8/2000 | Brady et al. | |
| 6,142,697 | A | 11/2000 | Williams | |
| 6,155,087 | A | 12/2000 | Necchi | 70/57.1 |
| 6,222,453 | B1 | 4/2001 | Joyce | |
| 6,244,462 | B1 | 6/2001 | Ehrensvärd et al. | 221/7 |
| 6,276,523 | B2 | 8/2001 | Sanders | |
| 6,374,648 | B1 | 4/2002 | Mitsuyama | 70/57.1 |
| 6,497,125 | B1 | 12/2002 | Necchi | 70/57.1 |
| 6,601,415 | B2 | 8/2003 | Takinami | 70/57.1 |
| 6,614,750 | B2 | 9/2003 | Weber et al. | 369/290 |
| 6,616,035 | B2 | 9/2003 | Ehrensvärd et al. | 235/380 |
| 6,619,079 | B2 | 9/2003 | Cheung | 70/57.1 |
| 6,628,199 | B1 | 9/2003 | Ehresnvärd et al. | 340/568.1 |
| 6,888,509 | B2 | 5/2005 | Atherton | 343/718 |
| 6,937,153 | B2 | 8/2005 | Redlin | 340/572.8 |
| 6,947,371 | B2 | 9/2005 | Bigley | 369/290.1 |
| 7,008,134 | B2 | 3/2006 | Lane | |
| 2002/0134119 | A1 | 9/2002 | Derman | 70/58 |
| 2002/0149479 | A1 | 10/2002 | Duschek et al. | 340/572.1 |
| 2002/0196126 | A1 * | 12/2002 | Eisenberg et al. | |
| 2003/0019770 | A1 | 1/2003 | Hodes | 206/308.2 |
| 2003/0094021 | A1 | 5/2003 | Takinami | 70/57.1 |
| 2003/0131638 | A1 | 7/2003 | Chang | 70/57.1 |
| 2003/0145635 | A1 | 8/2003 | Sheslow | 70/57.1 |
| 2003/0234190 | A1 | 12/2003 | Kuo | 206/308.2 |
| 2004/0008613 | A1 | 1/2004 | Beckwith et al. | 369/291 |

OTHER PUBLICATIONS

"Roland Piquepaille's Technology Trends"; "*Cypak Mounts CPUs On Paper. Can Disposable PC's be far off?*"; web page article from http://radio.weblogs.com/0105910/2003/02/03.html; Jan. 3, 2004.

RFID Journal "*The Package Is the Computer*"; web page article from http://www.rfidjournal.com/article/view/301; Feb. 11, 2003.

"*04 01 13 Cypak signs agreement to license proprietary intelligent pharmaceutical packaging technology to MeadWestvaco Healthcare Packaging*;" web page article from http://.cypak.com?test_site/index.php?a=pressroom&b=news &page=news_meadwestvaco04...; Jan. 13, 2004; www.cypak.com, Cypak, AB, Funkens Gränd 1, Box 2332, 103 18 Stockholm, Sweden.

MeadWestvaco, Healthcare Packaging, announcement, New York, NY Apr. 2, 2004, "*MeadWestvaco Healthcare Packaging enhance electronic compliance packaging offering using Cypak AB Products*".

Smart Healthcare USA 2004, "*RFID and Smart Packaging in healthcare*"; web page article from http://www.idtechex.com/smarthealthcareusa/4.asp; Jun. 10-11, 2004.

"*The Swedidh Industrial Development Fund and IT Provider invest in Cypak*"; web page article from http://64.233.179.104/search?q=cache:rKf2CZYzvIoJ:cypak.vnewscenter.com/press.jsp%3Fid%3...; Aug. 18, 2004, www.cypak.com, Cypak AB, Funckens Gränd 1, Box 2332, 103 18 Stockholm, Sweden.

Conference Report: "Smarter Packaging", Packworld.com *Packaging World Magazine*; web page article from http://www.packworld.com/articles/Features/18411html, Nov. 2004.

"*About SenTech*"; web page article from http://www.sentecheas.com/about.htm; www.cypak.com, Sen Tech EAS Corporation, 2843 Centerport Circle, Pompano Beach, FL 33064, at least as early as Apr. 2004.

"Intelligent Pharmaceutical Packaging"; "*Summary*" and IPP PowerPoint™ presentation from http://www.cypak.com/index.php?a=products&b=ipp&c=summary&page=products_ipp; www.cypak.com, Cypak AB, Funckens Gränd 1, Box 2332, 1103 18 Stockholm, Sweden, at least as early as Apr. 2004.

"Intelligent Pharmaceutical Packaging"; "*Articles*"; web page articale from http://www.cypak.com/index.php?a=pressroom &b=articles&page=pressroom_articles; www.cypak.com, Cypak AB, Funckens Gränd 1, Box 2332, 103 18 Stockholm, Sweden, at least as early as Apr. 2004.

"*The Connected Drug Box*"; web page article from http:..web.archive.org/web/20021209044120/cypak.com/index.php?a=pressroom&b=news&page...; www.cypak.com, Cypak AB, Funckens Gränd 1, Box 2332, 103 18 Stockholm, Sweden, at least as early as Apr. 2004.

"*Electronic Compliance Packaging*"; web page article from http://web.archive.org'web/20030409195629/www.cypak.com/index.php?a=products&b=packaging&page=products_packaging; www.cypak.com, Cypak AB, Funckens Gränd 1, Box 2332, 103 18 Stockholm, Sweden, at least as early as Apr. 2004.

"*We are innovators . . .* "; web page article from http://web.archive.org/web/20031206192144/http://cypak.com; www.cypak.com, Cypak AB, Funckens Gränd 1, Box 2332, 103 18 Stockholm, Sweden, at least as early as Apr. 2004.

KR 535 Tabmaster Product Flyer, "*The KR 535 makes tabbing of paper products faster and easier than ever. Here's why . . .* ", Kirk Rudy, Inc., 2700 Kennesaw Due West Road, Kennesaw, GA., USA 30144, at least as early as Apr. 2004.

KR 203P Attaching System Product Flyer, "*The KR 203P attaches a wide variety of cards and pre-packaged samples onto various mailers and inserts*", Kirk Rudy, Inc., 2700 Kennesaw Due West Road, Kennesaw, GA., USA 30144, at least as early as Apr. 2004.

The ENDPAPER, "RFID Tags and ALA", p. 9, Library Binding Institute, 14 Bay Tree Lane, Tequesta, FL 33469 (May 2005).

MSN search "acousticmagnetic" listing Sentech Acousto-Magnetic (AM) Tags, www.sentecheas.com (search conducted Aug. 12, 2004).

Sentech EAS Corporation, Product Listings (2 pages), RF Technology (1 page), and About Sentech (1 page), www.sentecheas.com, (prior to Apr. 14, 2004.

International Search Report, PCT/US05/13105 (Jan. 31, 2007).

* cited by examiner

HARD COVER PRODUCT WITH SPINE-DISPOSED CONCEALED SECURITY DEVICE

The present application claims priority to provisional patent application Ser. No. 60/562,586, filed Apr. 14, 2004, and incorporates same herein by reference.

TECHNICAL FIELD

The present invention relates to hard cover products. More particularly, the present invention relates to a hard cover book product having a spine that concealingly holds a security device and manufacture of such hard cover book products.

BACKGROUND OF THE INVENTION

In recent years, tracking of inventory of goods has become of increased importance. Inventory of goods represents a significant investment in capital. In addition to cost factors, other aspects prompting increased interest in tracking inventory include the increase in just-in-time manufacturing in which materials are provided by suppliers shortly prior to the time of use by the manufacturer of goods, as well as theft deterrence and inventory verification and auditing.

Various electronic and mechanical devices have been provided for tracking and monitoring of goods and containers. These devices include acoustic magnetic security strips and radio frequency security tags. These devices often are embodied in tags, pods, labels, or patches, having adhesive surfaces for attaching the device to the goods or their containers. These devices facilitate tracking and monitoring of goods and containers. The security devices are typically attached to the articles particularly susceptible to pilferage and improper removal from a warehouse or retail store. The security devices include a detectable sensor. One known type of security tag has a circuit that resonates at a predetermined detection frequency range. A transmitter provides electromagnetic energy that excites the circuit. A receiver detects the output signal from the resonating circuit. The transmitter and the receiver are located at detection points, often exits from retail facilities. As the article is carried through the detection point, the receiver signals an alert when an activated sensor device is detected. For articles that are permitted to pass (such as purchased articles), a separate device is used to deactivate the detectable sensor prior to passage. Other devices include RFID devices that communicate digital signals. In some known RFID devices, the signal is indicative of unique identifiers for tracking particular containers.

Often large retailers require manufacturers of articles to include tracking and monitoring devices within the containers for the articles. For smaller retailers and smaller inventories of articles, the tracking and monitoring devices may not be included with or attached to containers. In such circumstances, the articles may be provided with aftermarket tracking and monitoring devices. For example, electronic article surveillance tags are available with adhesive backing to secure the tags to the containers. While the containers are thereby subject to electronic article surveillance, the adhesively attached tags experience problems during use. One significant problem is that the tags, being on the exterior of the container, are susceptible to removal. Removing the security tag facilitates unauthorized removal of the article from the secured area. However, removal by a purchaser also causes problems. The covering to which the security tag attaches may become torn or ripped. The package with the security tag, or without such by removal is unattractive. The security tag may also overlie or cover over ornamental graphics or text on the packaging.

Libraries present an especially interesting application area for concealed security devices. Librarys typically have a large inventory of books that are readily portable products. Some specialty books, rare books, and the like are susceptible to unauthorized removal. To prevent these inventory loss problems, sensor-interrogating devices are positioned near exit doors. The interrogator communicates with sensors positioned in the books. A properly checked out book will have the sensor deactivated. If the sensor signals the interrogator, an alarm is sounded. These sensor and interrogator systems for libraries however are retrofit devices, in which the sensor is manually installed at the library. The book is held with the covers splayed apart to open a gap in the spine portion of the book. The gap typically forms between the cover and the spine edge of the bound pages forming the book. A special tool is used to insert the sensor device along the open pathway defined by the gap. Once the sensor device is positioned, typically in a central portion of the spine, the book covers are closed together and the tool is withdrawn thereby depositing the security device in the spine. Often the security device has an adhesive surface in order to attach the security device to the spine of the book. For books that do not develop such a gap upon opening the covers, the security device must be positioned on one of the pages, typically in a central portion of the book. This leaves the sensor susceptible to removal. Installing the sensor devices is time consuming and the books must be periodically checked to determine whether the sensor device remains in place. It is also difficult to assure proper placement and securing of the sensor device within the spine.

Accordingly, there is a need in the art for providing hard cover books with in-spine concealed security tracking and monitoring devices. It is to such that the present invention is directed.

SUMMARY OF THE INVENTION

The present invention meets the need in the art by providing a hard cover book product comprised of an outer liner that includes a pair of hard sheet members attached to a major surface of the outer liner and disposed in spaced-apart relation to define a spine portion therebetween, with the hard sheet members folding movably toward each other along the edges with the outer liner. A security tag attaches within the spine portion and a body portion attaches to the hard sheet members. The sensor provides for tracking of the hard cover book product by responding to a remote interrogator.

Objects, advantages and features of the present invention will become apparent from reading of the following detailed description of the invention and claims in view of the appended drawings.

DETAILED DESCRIPTION

Figure 1:
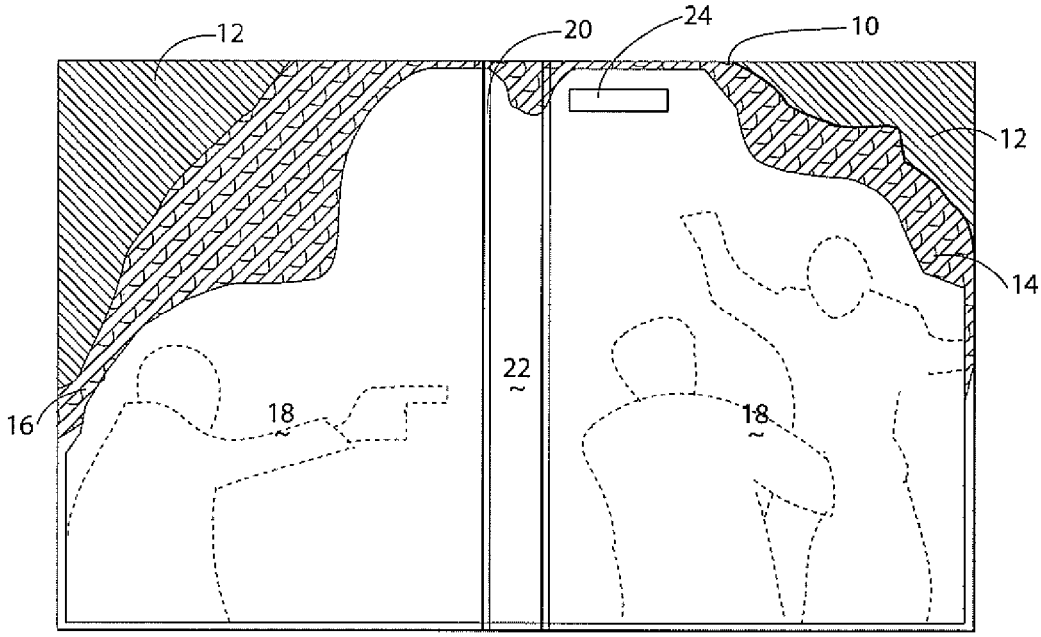
Fig. 1 Prior Art
FIG. 1 is a plan view of a hard cover product in which a security device is attached to an exterior surface.
Figure 2:
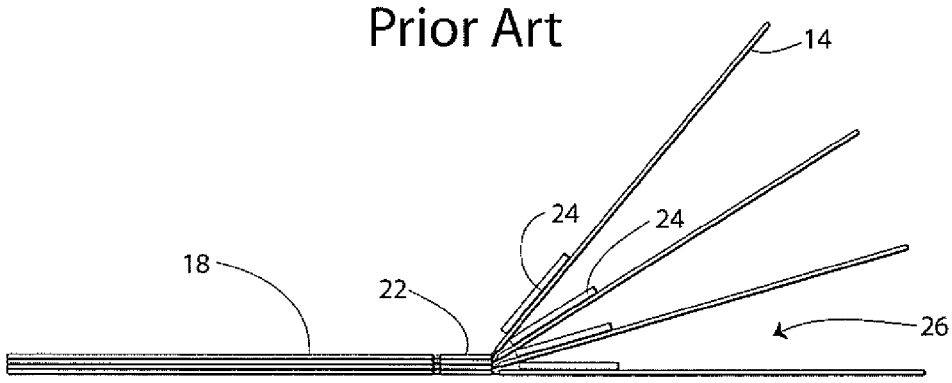
Fig. 2 Prior Art
FIG. 2 is a end view of a stack of assemblies used to make a hard cover product illustrated in FIG. 1.

Referring now in more detail to the drawings in which like numerals refer to like parts throughout the several views, FIG. 1 illustrates a hard cover product 10 having an outer liner 12, a pair of spaced-apart sheets 14, 16, and covered by an inner liner 18. The enclosed sheets 14, 16 define front and back covers for the product. A pair of spaced-apart grooves or scores 20 enable the sheets 14, 16 to fold together to close the hard cover product 10. A gap 22 between the scores 20 defines a spine or back of the closeable hard cover product 10. A security sensor 24 attaches with adhesive to the face of the inner liner 18 in a selected position. The sensor extends above the surface defined by the inner liner 18. As illustrated in FIG. 2, this can lead to handling and production problems during manufacture of the hard cover product 10. The upwardly extending security sensor causes a portion of the stack to be disposed an oblique angle 26, rather than lying flat. This uneven stack makes handling of work in progress more difficult.

Figure 3:
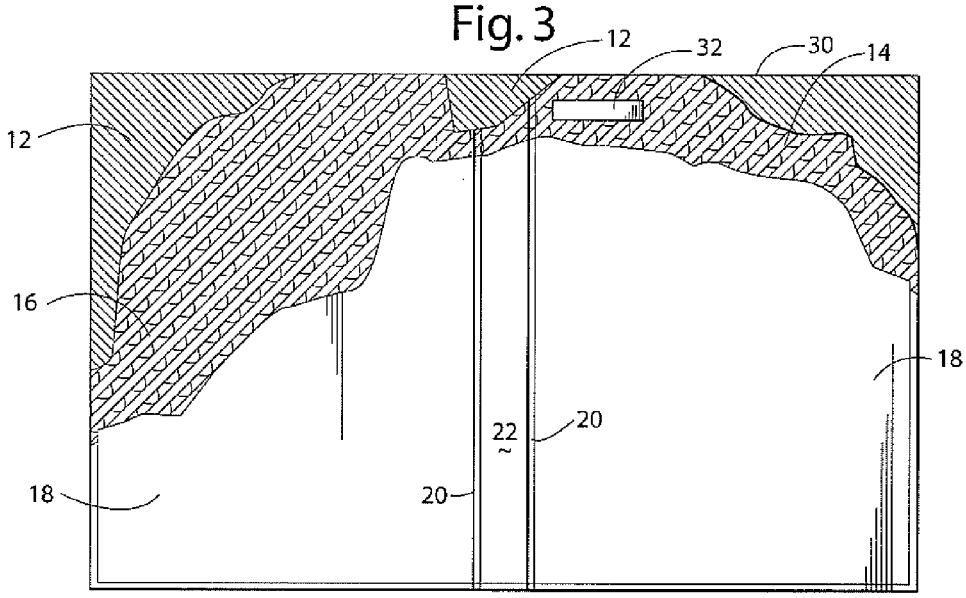
FIG. 3 is a plan view of an embodiment of the present invention providing a hard cover product with a concealed security device.
Figure 4:
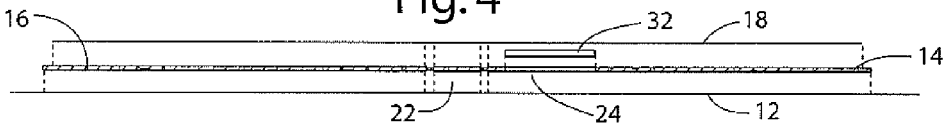
FIG. 4 is an exploded edge view of the hard cover product assembly illustrated in FIG. 3.

FIG. 3 illustrates a hard cover product 30 according to the present invention in which the security sensor 24 is concealed within an assembly of the outer liner 12, the sheets 14, 16, and the inner liner 18. FIG. 4 is an exploded edge view of the hard cover product assembly illustrated in FIG. 3. A recess 32 is formed in the sheet 14 such as by die cutting the sheet in a casing operation typical for binding of books using a casing machine. An applicator apparatus places the security sensor 24 within the recess 32. The outer liner 12 closes the recess 32 from an exterior side of the assembly for the hard cover product 30, and the inner liner 18 closes the recess 32 from the opposing interior side. The inner liner 18 thereby conceals the security device 24 within the hard cover product 30.

The thickness of the sheet 14 (on a line 34 shown in FIG. 4 transverse through the opposing major surfaces) is preferably sufficient that the security device 24 is recessed in the recess 32 relative to the major surfaces. The sheets 14, 16 are cardboard sheet, fiberboard sheets, or other stiff or hard sheet material suitable for forming a cover to a book, casing, or other article-container.

In the illustrated embodiment, the gap 22 defines scores or grooves in the overlapped inner and outer lines 12, 18. These define pivots or lines on which the front and back covers fold together.

Figure 5:
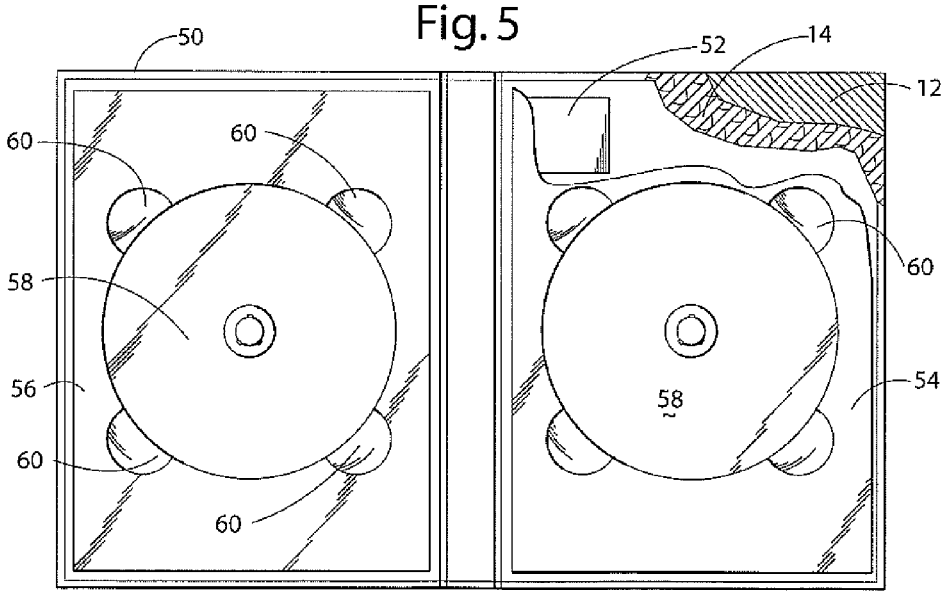
FIG. 5 is a plan view of an alternate embodiment of the hard cover product according to the present invention.

FIG. 5 illustrates an alternate embodiment of a hard cover product 50 according to the present invention. In this embodiment, a substantially planner radio frequency tag 52 attaches to the surface of the sheet 14*a*. The inner liner 18 attaches in overlaying relation to the sheets 14, 16. In the illustrated embodiment, which does not include the recess 32, the inner liner 18 extends over the area of the spine. The inner liner 18 thereby overlies and concealing encloses the sheet-like security tag 52. The security tag 52 is perceptible as a slight bulge, but generally does not detract from the graphics or text on the inner liner.

Figure 8A:
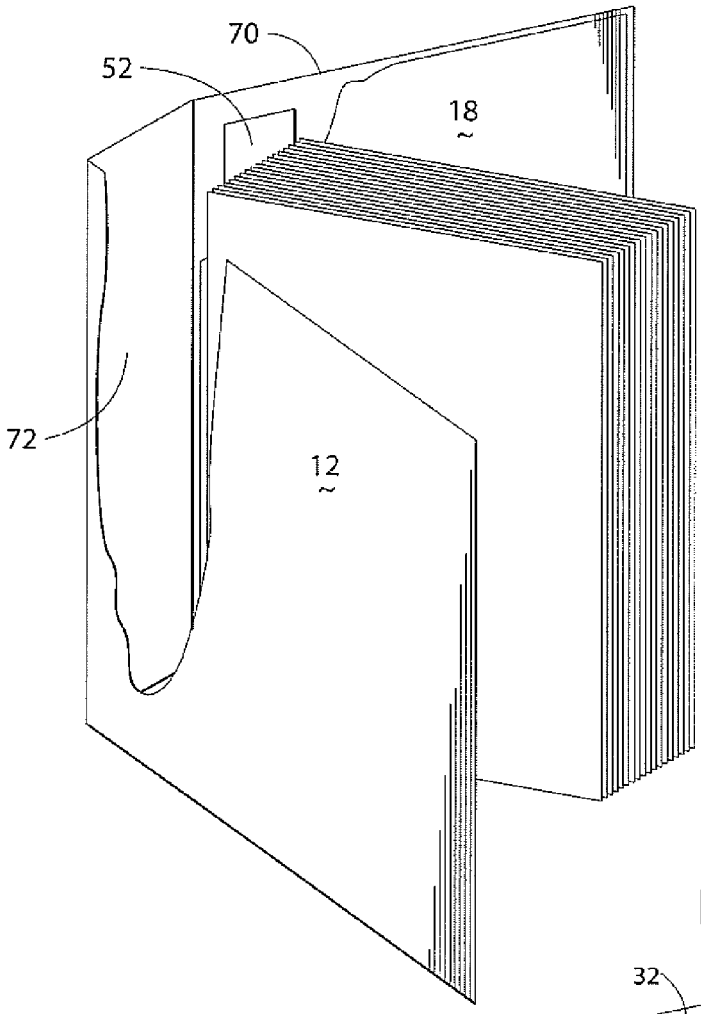
FIG. 8A is a perspective exploded view of a hard cover product with a bound assembly of papers for a book.
Figure 8B:
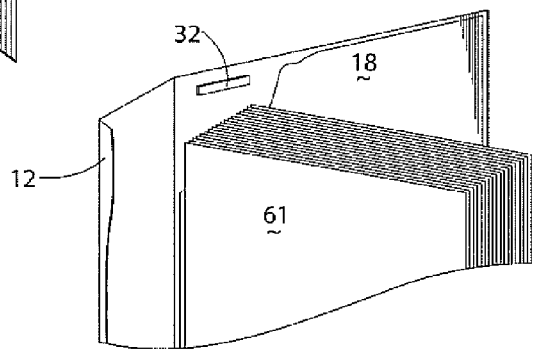
FIG. 8B is a perspective exploded view of a hard cover product with a bound assembly of papers for a book.

In the illustrated embodiment, the hard cover product 50 attaches to an interior body, such as plastic matingly engagable plastic diskholders, configured for receiving compact discs or DVD discs. However, the interior body may be a bound assembly of papers for a book. Other shell devices that define an interior body for the hard cover product may be gainfully attached to the interior front and back covers, such as for packaging small articles, video tapes, books, ring binders, or other articles. For example, FIGS. 8A and 8B illustrate a bound assembly 61 of paper sheets containing printed material to be bound in the hard cover product as a book. The bound assembly 61 attaches to the spine 22. In embodiment illustrated in FIG. 8A uses the sheet-like security tag 52, while the embodiment illustrated in FIG. 8B uses the security tag 24.

Figure 6:
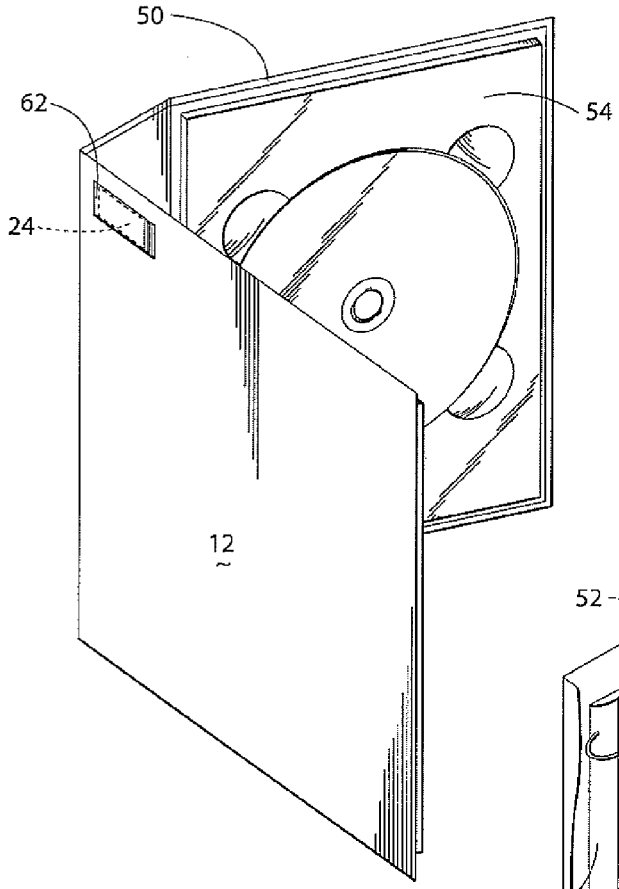
FIG. 6 is a perspective view of a hard cover product illustrating features of the present invention.

FIG. 6 illustrates the hard cover product 50 in which the outer liner 12 includes an indicia 62 such as a bar code or other product inventory number. In this embodiment, the recess 32 for the security tag 24 (or security tag 52 attached to the sheet 14) is disposed substantially in alignment with the indicia 62. In this way, a security tag detector deactivates the security tag when the hard cover product 30 is scanned for pricing, so that the product can be taken from a store without triggering alarms.

Figure 7:
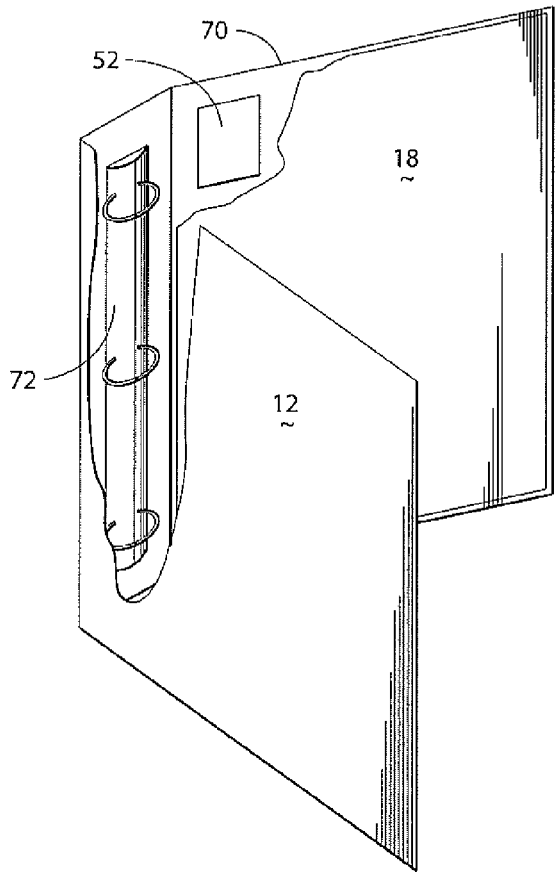
FIG. 7 is a perspective view of an alternate embodiment of the hard cover product according to the present invention.

FIG. 7 illustrates an alternate embodiment of a hard cover product 70 that includes a three-ring binder assembly 72. In this embodiment, the sheet 14 receives one of the sheet-like security devices 52, although in an alternate embodiment, the sheet defining front (or back) cover includes the recess 32.

Figure 9:
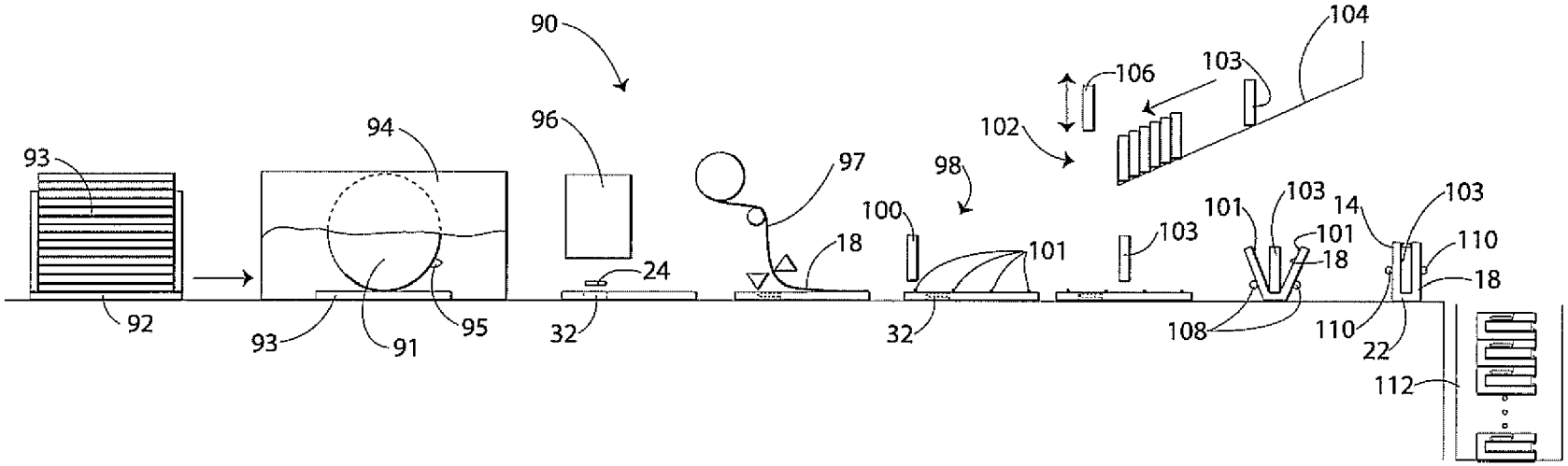
FIG. 9 is a schematic illustration of an assembly line for manufacturing hard cover products of the present invention.

FIG. 9 is a schematic illustration of an assembly line 90 for manufacturing hard cover products of the present invention discussed above. The assembly line 90 includes a supply hopper 92 that receives a stack 93 of interim assemblies of the hard cover product. A casing machine 94 operates to cut blanks of cardboard sheets to define the front and back cover bodies enclosed in the outer and inner liners. The casing machine 94 also includes a rotatable cylinder 91 with a cutter 95 for slitting open the recess 32. An interim assembly of the hard cover product includes the outer liner 12 attached to the sheets 14, 16. A label applicator 96 receives a supply of security tags 24 and positions one in the recess 32 or on the sheet 14 (for a sheet type security tag). Operation of the assembly line in a first stage of manufacture results in interim assemblies that are subsequently returned to the hopper for attaching the inner liner 18.

The assembly line 90 further includes an inner liner application station 97 in which the inner liner 18 is attached in overlying relation to the major surfaces of the sheets 14, 16 opposing the outer liner 12. A glue station 98 includes an adhesive applicator 100 for depositing a selected adhesive 101 to the inner liner 18. A casing applicator 102 includes a supply hopper 104 that holds a plurality of interior bodies or casings 103, such as the engageable shells 54, 56. A metering device 106 causes one of the casings 103 to be positioned on the spine 22. Opposing ploughs 108 guide the opposing front and back covers to pivot together to foldingly close the hard cover product. Rollers 110 bear against the opposing covers to close the hard cover product and to force the casing 103 into engaging contact with the adhesive. The completed, closed hard cover product then is received in a stacker 112 for packaging.

Figure 10:
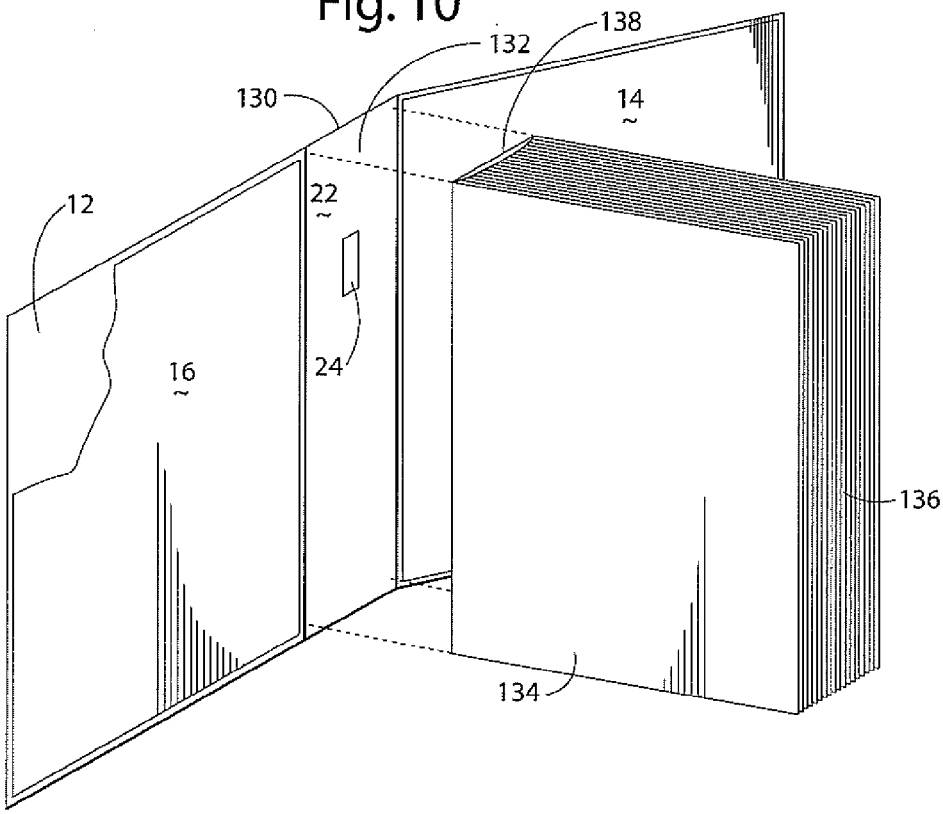
FIG. 10 is an exploded perspective illustration of a hard cover book having a security device in a spine portion according to the present invention.

FIG. 10 is a perspective exploded view of a hard cover book 130 having an outer liner 12 with the spaced-apart hard cover sheets 14, 16. Perimeter edge portions of the outer liner 12 overlap the outer edges of the sheets 14, 16. The sheets 14,16 are spaced apart and attached to an inner surface of the outer liner 12. This defines the gap 22 for a spine 132 or back of the hard cover book 130. The security sensor 24 attaches with adhesive to the face of the inner liner in a selected position in the spine portion 132. A book block 134 made of a bound assembly of printed pages 136 for the book attaches conventionally to the spine 22 and the covers 14, 16 of the book 130. The book block or body 134 includes a plurality of pages 136 bound conventionally together at a back portion 138 that defines the spine or back of the book block 134.

Figure 10A:
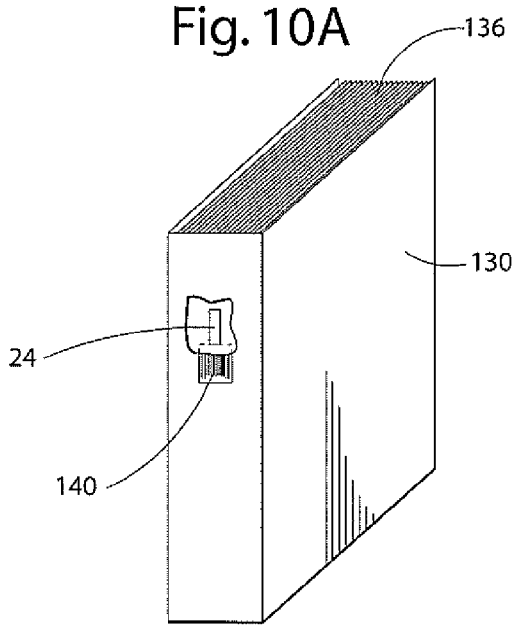
FIG. 10A is a back perspective partially cut-away illustration of the hard cover book illustrated in FIG. 10.

With reference to FIG. 10A showing a back perspective partially cut-away view of the book 130, the front cover 12 includes a preprinted bar code 140. The sensor device 24 attaches to the spine 132 in opposed alignment with the bar code 140. This facilitates use of pricing scanners/sensor deactivators that read the bar code for inventory control and pricing while deactivating the security device, for example, by a cashier at a payment or checkout station, as well as for use by a library for tracking its book inventory.

Figure 11:
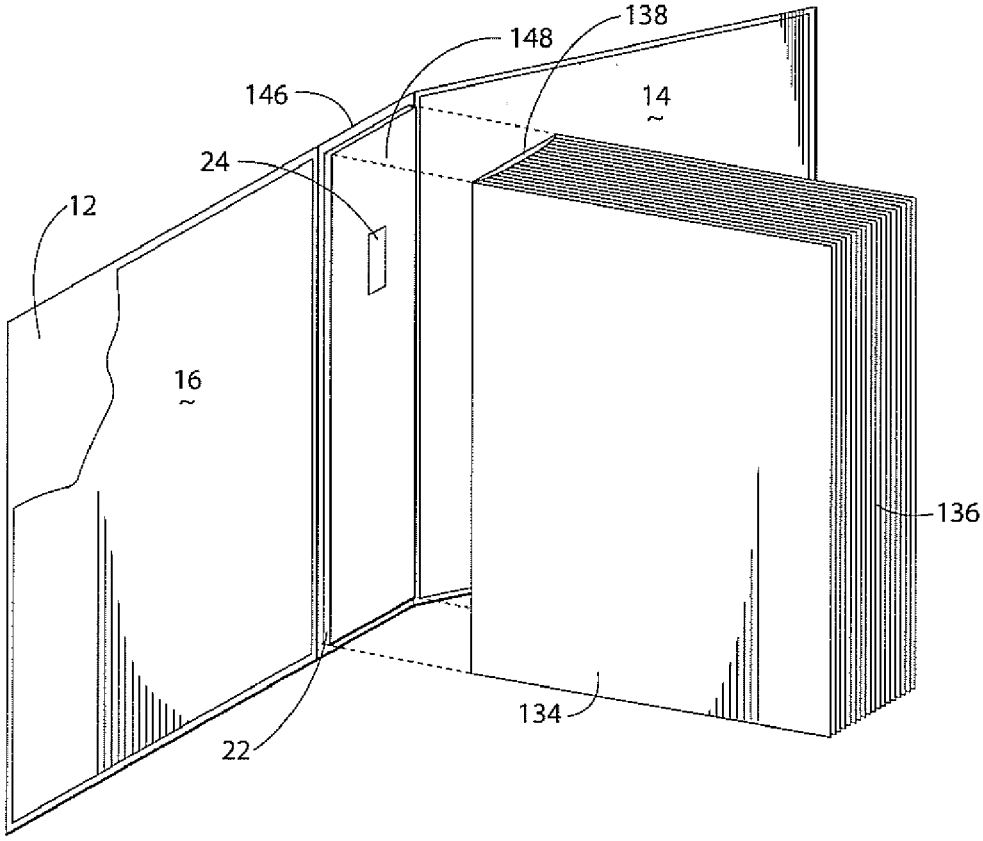
FIG. 11 is an exploded perspective view of a second embodiment of a hard cover book having an in-spine security device according to the present invention.

In the embodiment illustrated in FIG. 10, the sensor device 24 attaches to the inner surface of the outer cover 12. FIG. 11 is a perspective view of a second embodiment of a hard cover book 146. In this embodiment, the spine 22 is defined by the spaced apart hard cover sheets 14, 16, as well as a spine member 148. The spine member 148 defines gaps 150, 152 relative to the adjacent edges of the hard cover sheets 14,16 for folding the hard covers towards each other to close the book 146. The security device 24 attaches to the spine member 148. It is to be appreciated that the spine member 148 in an alternate embodiment includes a recess such as the recess 32 formed in the sheet 14, for receiving the security device 24.

Figure 12:
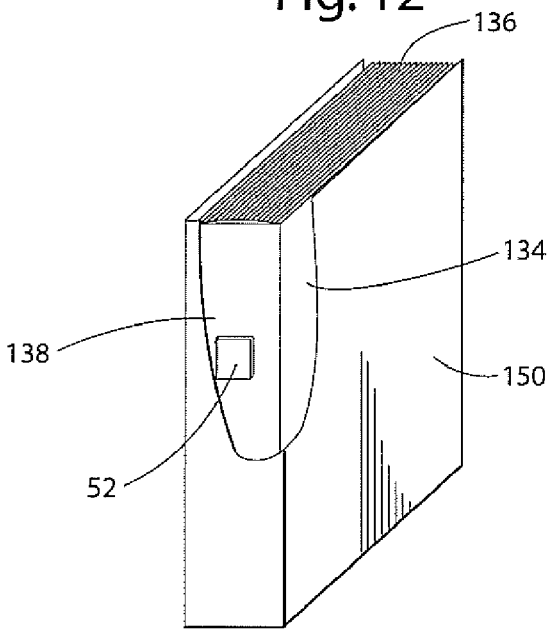
FIG. 12 is a perspective cut-away back view of a third embodiment of hard cover book having an in-spine security device according to the present invention.

FIG. 12 is a back perspective partially cut-away view of a third embodiment of a hard cover book 150 in which a substantially planar radio frequency tag 52 attaches to the spine 138 of the book block 134 prior to attachment of the book body to the spine 132.

With reference to FIGS. 10–12, the hard cover book products 130, 146 and 150 each have a spine portion that concealingly holds a security device such as the security sensor 24, the radio frequency tag 52, or the like remotely interrogated sensor within the spine portion. As illustrated in these embodiments, the security device is readily disposed on an inner surface of the spine 132 opposing the back 138 of the book block 134, on (or in a recess in) the spine member 148, or on the back 138 of the book block 134. The hard cover book products are readily manufactured in accordance with conventional book binding processes with the addition of a label depositing apparatus in an appropriate portion of the manufacturing line. The embodiments illustrated in FIGS. 10 and 11 provide the label depositing apparatus in the manufacturing line for assembly of the cover for the hard cover book product. The embodiment illustrated in FIG. 12 provides for attaching the security device to the back 138 of the book body during assembly of the book body to the cover during conventional casing in line.

Casing in line involves securing the book body to the cover typically with adhesive. A belt conveyor for casing in line carries the book block with the spine upwardly disposed. Rollers apply glue to the front and back end sheets of the book block and the back for attaching a fiberboard or Kraft paper liner on the spine. In the embodiment illustrated in FIG. 12, the label-attaching device deposits a security device to the back selectively before or after attaching the fiberboard liner on the spine. The cover is then overlaid on the book block 134, and the spine 22 keeps the cover in place relative to the book block. The front and back covers are moved into contact with the adhesive on the interior surfaces of the sheets 14, 16. A building-in device having heated pressure plates closes against the front and back of the book sandwiching the assembly of the cover and the book block to cure the adhesive. The assembled book products are stacked and packaged for shipment and storage.

This specification has described the present invention that provides a hard cover product with a security device concealed within a spine, including the steps necessary for making and using various embodiments thereof. It is to be understood, however, that numerous changes and variations may be made in the construction of the present hard cover product within the spirit and scope of the present invention, and that modifications and changes may be made therein without departing from the scope thereof as set forth in the appended claims.

What is claimed is:

1. A hard cover product, comprising:

an outer liner;

a pair of sheet members attached to a major surface of the outer liner and disposed in spaced-apart relation to define a spine portion therebetween, the sheet members foldingly movable towards each other along respective opposing edges on the outer liner;

a spine member attached to the outer liner in the spine portion between the spaced-apart members and defining lateral gaps between the respective sheet member and a side edge of the spine member, the spine member defining a recess therein;

a security tag attached within the recess in the spine member; and a body attached to the sheet members, wherein the hard cover product is trackable by the security tag concealed within the recess being responsive to a remote interrogator.

2. The hard cover product as recited in claim 1, wherein the security tag attaches in the recess facing the outer liner.

3. The hard cover product as recited in claim 1, wherein the security tag attaches in the recess facing the body.

4. The hard cover product as recited in claim 1, further comprising an inner liner attached overlying the pair of sheet members.

5. The hard cover product as recited in claim 1, wherein the outer liner further defines a coded indicia displayed on a portion of the exterior surface.

6. The hard cover product as recited in claim 5, wherein the security tag is disposed in substantial alignment with the coded indicia.

7. The hard cover product as recited in claim 1, wherein the security tag is a sheet-like electronic response device.

8. The hard cover product as recited in claim 1, wherein the body comprises a shell configured for receiving a disc.

9. The hard cover product as recited in claim 1, wherein the body comprises a plurality of pages that define a loose-leaf book.

10. The hard cover product as recited in claim 1, wherein the body comprises a ring member for receiving sheets.

11. A hard cover book product, comprising:

an outer liner having an exterior surface that includes graphics images and a coded indicia;

a pair of opposing sheet members disposed in spaced-apart relation to define a spine portion in a gap therebetween and the sheet members attached to an inner surface of the outer liner, a perimeter portion of the outer liner overlapping laterally outward edge portions of the pair of sheet members;

a spine member attached to the outer liner in the spine portion between the spaced-apart members and defining lateral gaps between the respective sheet member and a side edge of the spine member, the spine member defining a recess therein;

a security tag attached within the recess in the spine member;

an inner liner overlying the pair of sheet members; and a body received within a space defined by the main sheet members folding together to define a front and back cover, whereby the hard cover book product is trackable by a remote interrogator that senses a response by the concealed security tag to a signal.

12. The hard cover product as recited in claim 11, wherein the body comprises opposing matingly engageable shells for receiving a disc, each one of the shells attached to a respective interior surface of the front and back covers.

13. The hard cover product as recited in claim 11, wherein the body comprises a plurality of pages that define a loose-leaf book.

14. The hard cover product as recited in claim 11, wherein the body comprises a ring member for receiving sheets.

* * * * *